United States Patent [19]

Guelck

[11] Patent Number: 4,683,675

[45] Date of Patent: Aug. 4, 1987

[54] SHOE FOR A CLOSURE

[75] Inventor: Volker Guelck, Waterloo, Canada

[73] Assignee: Illinois Tool Works Inc., Chicago, Ill.

[21] Appl. No.: 795,891

[22] Filed: Nov. 7, 1985

[51] Int. Cl.[4] ..... E05D 15/22

[52] U.S. Cl. ..... 49/181; 49/176

[58] Field of Search ..... 49/181, 176, 453

[56] References Cited

U.S. PATENT DOCUMENTS

| | | | |
|---|---|---|---|
| 1,166,356 | 12/1915 | Galley | 49/181 |
| 1,873,066 | 8/1931 | Stewart | 49/181 |
| 4,452,012 | 1/1984 | Deal | 49/181 |

*Primary Examiner*—Kenneth Downey

*Assistant Examiner*—Gerald A. Anderson

*Attorney, Agent, or Firm*—Daryl W. Schnurr

[57] ABSTRACT

A shoe is mounted between a frame and a sash of a window. The shoe has braking means that begin to engage almost immediately as the sash is rotated relative to the frame to prevent the sash from sliding relative to the frame. The shoe has a secondary means to assist in activating the braking means as the sash is rotated relative to the frame. When the sash is aligned with the frame, the braking means is automatically released and the sash and shoe can slide relative to the frame. The shoe and a projection that can engage with an indentation in the sash. The shoe has second engagement means that can engage with fourth engagement means on the sash to allow the sash to pivot relative to the shoe.

20 Claims, 11 Drawing Figures

SHOE FOR A CLOSURE

BACKGROUND OF THE INVENTION

1. Field of the Invention

This invention relates to a shoe for use with a sash of a closure and more particularly, to a shoe that allows a sash to slide relative to a frame or, alternatively, to be rotated relative to said frame.

2. Description of the Prior Art

There are numerous types of shoes available that are designed to be used with window sashes. However, the previous shoes suffer from disadvantages in that they sometimes fail to work; or, they are too complex; or, they are too expensive to manufacture; or, they contain too many separate components; or the braking means fails to prevent the sash from sliding relative to the window frame as the sash is rotated relative to said frame; or, the braking means fails to engage quickly enough as the sash is rotated relative to said frame; or, the sash can fall out of said frame because the braking means is inadequate; or, the shoe does not have a supplementary braking system.

SUMMARY OF THE INVENTION

It is an object of the present invention to provide a shoe for use with a sash of a closure, said shoe being relatively simple and inexpensive to manufacture, reliable and having braking means that are activated as soon as the sash begins to rotate relative to a frame.

A shoe can be used with a sash of a closure where the sash has means thereon for engaging said shoe and the sash is mounted in a frame. The shoe has a base with first and second engagement means located thereon said sash having third and fourth engagement means located thereon. The third and fourth engagement means correspond to the first and second engagement means respectively. The second and fourth engagement means together provide pivoting means so that said sash can be rotated relative to said frame about said second and fourth engagement means. The sash and shoe are slidable relative to said frame when said sash is parallel to said frame and said shoe is mounted between said sash and said frame with said first engagement means properly engaged with said third engagement means and said second engagement means properly engaged with said fourth engagement means, said shoe thereby being engaged at two locations along a length of said sash. The first and third engagement means are designed to disengage when said sash is rotated to a non-parallel position relative to said frame, said base having braking means located thereon. The braking means are activated, by said first engagement means, as soon as said first and third engagement means begin to disengage to prevent said shoe and said sash from sliding relative to said frame.

DESCRIPTION OF A PREFERRED EMBODIMENT

Figure 1:
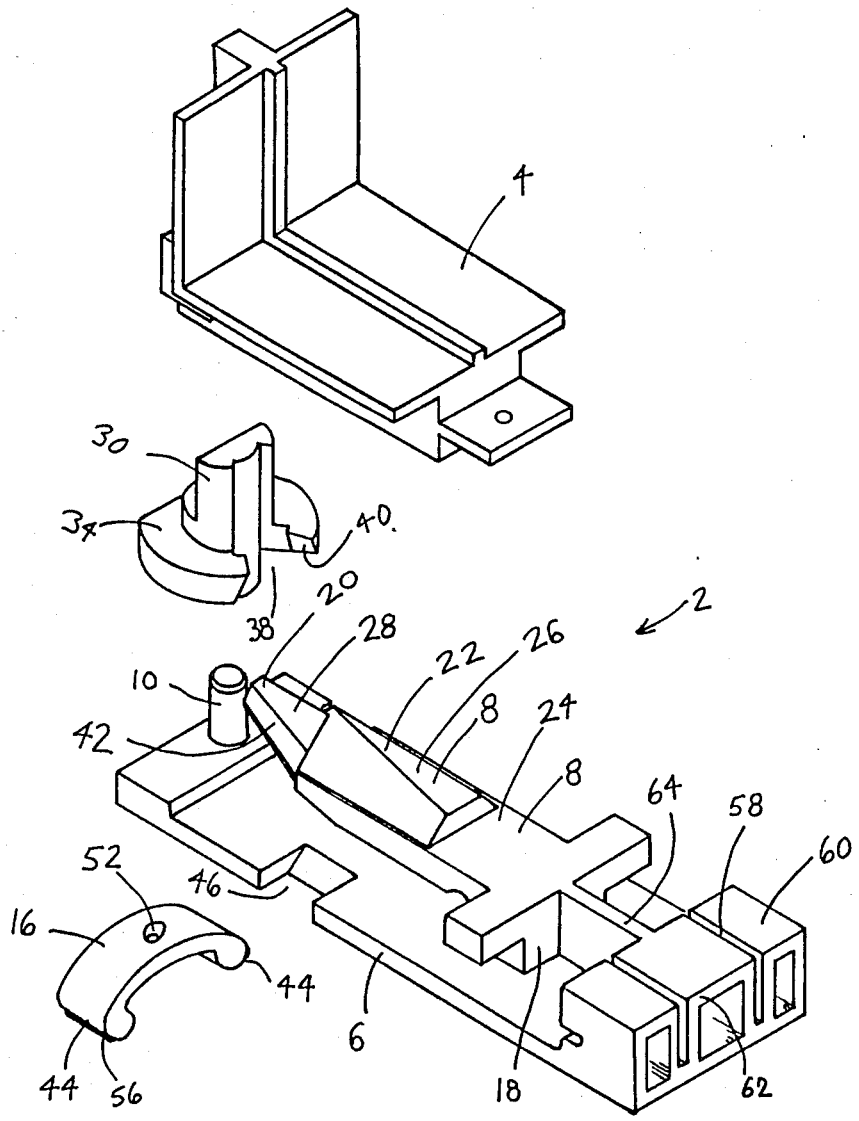
In FIG. 1, there is shown an exploded perspective view of a shoe and part of a sash.
Figure 2:
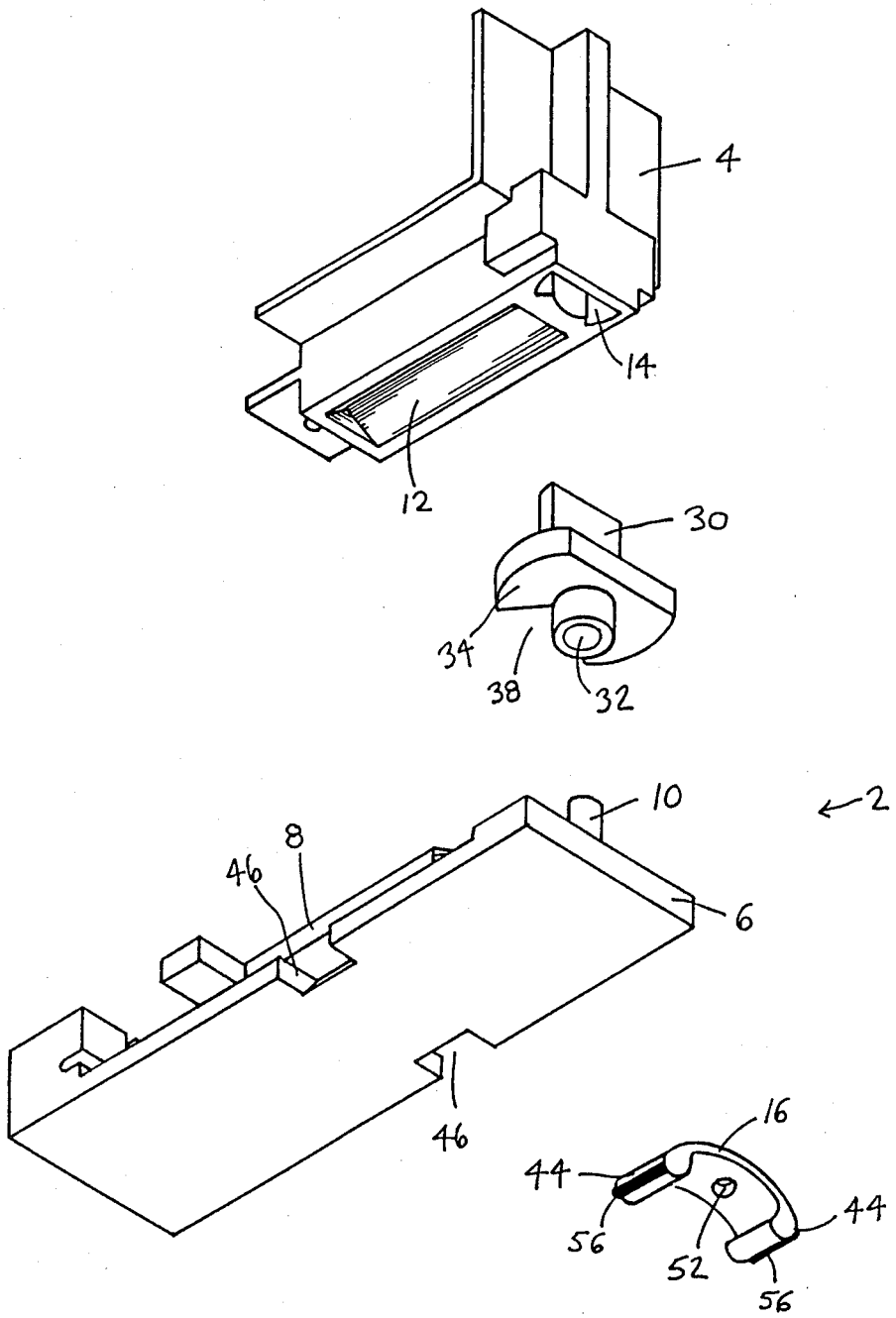
FIG. 2 is an exploded perspective view of the shoe and part of the sash from underneath.

In FIGS. 1 and 2, a shoe 2 is shown in a spaced relationship from part of a sash 4 of a closure (not shown), said closure preferably being a window. The sash 4 has means thereon for engaging said shoe 2 and is mounted in a frame (not shown in FIGS. 1 and 2). The shoe 2 has a base 6 with first engagement means 8 and second engagement means 10 located thereon. The sash 4 has third engagement means 12 and fourth engagement means 14 located thereon. The third and fourth engagement means 12, 14 correspond to said first and second engagement means 8, 10 respectively. The second engagement means 10 and the fourth engagement means 14 together provide pivoting means so that said sash 4 can be rotated relative to the frame (not shown in FIGS. 1 and 2) about said second and fourth engagement means. The base 6 has braking means 16 located thereon.

The first engagement means 8 is pivotally mounted on said shoe 2 relative to said base 6 and the braking means 16 is located between part of said first engagement means 8 and said base 6.

The first engagement means 8 is a projection having a fixed end 18 joined to said base 6 and a free end 20 capable of pivoting slightly about said fixed end 18. The projection 8 has a ridge 22 on an outer surface 24. The ridge 22 is part of the projection 8 and is shaped to engage said third engagement means 12 on said sash 4. The ridge 22 has an inverted V-shaped cross-section at an end nearest the free end 20, an outer surface of said ridge tapering gently to form a triangular flat surface 26 that increases in width toward the fixed end 18. At an end of the ridge 22 nearest the end 18 of the projection 8, the ridge 22 has a cross-section similar to a truncated isosceles triangle. The third engagement means 12 is an indentation with a V-shape similar to the inverted V-shaped portion of the ridge 22 so that said ridge will fit snugly within said third engagement means or indentation 12. Alternatively, the indentation 12 can be a mirror image of the ridge 22 of said projection 8.

The second engagement means 10 is a cylindrical post mounted normal to said base 6. The fourth engagement means 14 can be an opening of similar size and shape to said post 10 so that said post 10 will fit snugly within said opening 14 on said sash to allow said sash to pivot relative to said shoe 2 and said frame (not shown).

Preferably, the projection 8 has an extension 28 located thereon so that a free end 20 of said projection 8 is located immediately adjacent to said second engagement means 10 and said fourth engagement means 14. A sleeve 30 is preferably positioned between said second engagement means 10 and said forth engagement means 14. The sleeve 30 is shaped to interact with said extension 28 so that, when said sash 4 is rotated relative to said frame (not shown) by an amount equal to or greater than approximately 7°, part of said sleeve 30 engages said extension 28, thereby forcing said projection 8 against said braking means 16 and assisting in activating said braking means. When the sleeve 30 is located between said post 10 and said fourth engagement means 14, the opening in said fourth engagement means corresponds, not to the shape of the post 10, but to the shape of the sleeve 30. The sleeve 30 has an exterior shape that is non-circular so that the sleeve 30 will rotate with the sash 4 about said post 10. The sleeve 30 has a hollow cylinder 32 designed to snugly and rotatably fit over said post 10.

When the sleeve 30 is located between said post 10 and said fourth engagement means 14, the opening of the fourth engagement means has a similar size and shape to part of said sleeve 30, as shown in FIG. 2, so that part of said sleeve will fit snugly within said opening on said sash 4 to allow said sash to pivot relative to said shoe and said frame (not shown in FIGS. 1 and 2). As the sash 4 pivots, the sleeve 30 will also pivot relative to said shoe 2 on said post 10.

The sleeve 30 has a flange 34 extending outwardly from an end of said sleeve 30 adjacent to said base 6. The flange 34 has a flat surface 36 on a side opposite to said projection 8. A segment of said flange 34 is removed on a side adjacent to said projection 8. The extension 28 of the projection 8 extends into said cut-away segment 38. The opening of the fourth engagement means 14 is shaped so that the flange 34 and a lower part of the sleeve 30 will not fit within said opening. As said sash 4 is rotated relative to said frame (not shown in FIGS. 1 and 2) by an amount equal to or greater than approximately 7° in either direction, said flange 34 engages said extension 28 thereby forcing it against said braking means 16 and assisting in activating said braking means.

Preferably, edges 40 of the flange 34 adjacent to the cut-away segment 38 are shaped at an oblique angle to assist the sleeve 30 in overriding the extension 28. Further, edges 42 of the extension 28 are preferably shaped at an oblique angle opposite to the oblique angle of the edges 40 of the flange 34 to assist the sleeve 30 in overriding the extension 28. Part of the sleeve 30 fits snugly within the opening of the fourth engagement means 14 of the sash 4, said part of said sleeve and said opening being shaped so that the sleeve 30 rotates as the sash 4 rotates.

The braking means 16 is an elongated C-shaped portion with two ends 44. The installation of the braking means 16 on the base 6 can best be seen in FIGS. 3 and 5. The base 6 has cut-out portions 46 located on either side thereof, said cut-out portions being shaped to receive the ends 44 of the braking means 16. A centre of said C-shaped portion 16 extends against said projection 8 at all times. The braking means 16 are flexible and resilient so that as the projection 8 is forced towards said base 6, said C-shaped portion 16 becomes flatter, thereby causing said ends 44 to exert pressure against adjacent walls 48 of said frame 50, said walls and said frame being shown as dotted lines in FIGS. 3 to 11.

As the ends 44 exert pressure against the adjacent walls 48, said shoe 2 is prevented from sliding relative to said frame 50. The braking means 16 has a suitable opening 52 located therein and a lower surface of the projection 8 has a suitable bead 54 thereon so that said bead 54 will fit snugly within said opening 52. In this way, the braking means 16 is retained in position relative to said projection 8.

Preferably, the ends 44 of the C-shaped portion 16 have a suitable surface to increase the friction between said ends and the walls 48 of said frame 50. Still more preferably, the suitable surface is a rubbery material or coating 56 that is affixed to said ends 44.

It can be readily seen that the shoe 2 has three separate components, said components being the sleeve 30, the braking means 16 and the remainder of the shoe 2. The remainder of said shoe 2 is one piece and includes the base 6, the projection 8, the cylindrical post 10 and the fixed end 18 of said projection 8. The fixed end 18 is integral with said base 6. Slots 58 are located in a block 60 at an end 62 of said base 6 and provide a means for anchoring and receiving one end of a spiral spring (not shown) when said shoe is used with a double hung window (not shown). A reinforcing wall 64 extends between the block 60 and the end 18 to provide support for the projection 8.

Figure 3:
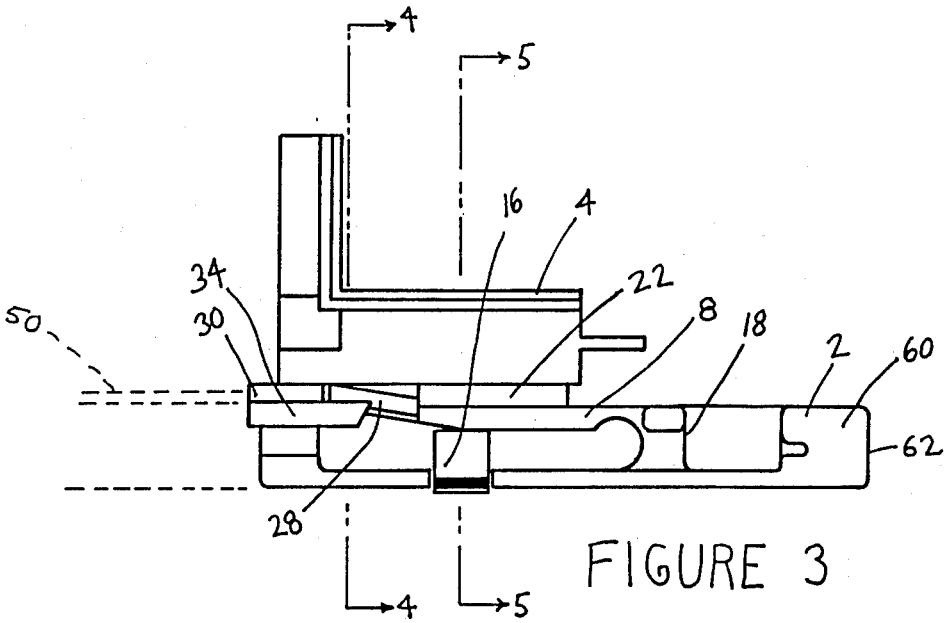
FIG. 3 is a side view of a shoe with a braking means in a disengaged position.
Figure 4:
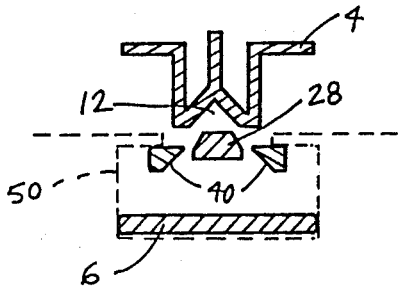
FIG. 4 is a sectional end view of the shoe through the section 4—4 of FIG. 3.
Figure 5:
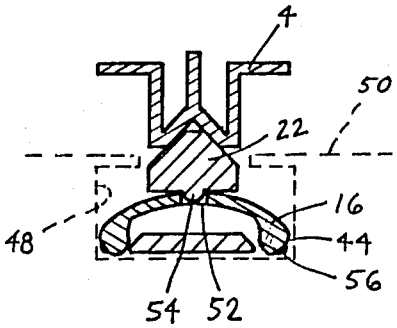
FIG. 5 is a sectional end view of the shoe along the lines 5—5 of FIG. 3.

In operation, the shoe can best be described from FIGS. 3 to 11, inclusive. The same reference numerals are used in FIGS. 3 to 11 as those used in FIGS. 1 and 2 to describe the same components. In FIGS. 3, 4 and 5, the shoe is said to be in an "engaged" position, with said first engaging means 8 engaged with said third engagement means 12. In other words, the ridge 22 is located within the indentation 12 of the third engagement means 12.

In the position shown in FIGS. 3, 4 and 5, the braking means 16 is in a relaxed position and the ends 44 are out of contact with the walls 48. The extension 28 is out of contact with the flange 34. The ridge 22 is engaged in third engagement means 12 as the sash 4 is aligned with the shoe 2. In this position, the shoe 2 and the sash 4 are free to slide together relative to the frame 50.

Figure 6:
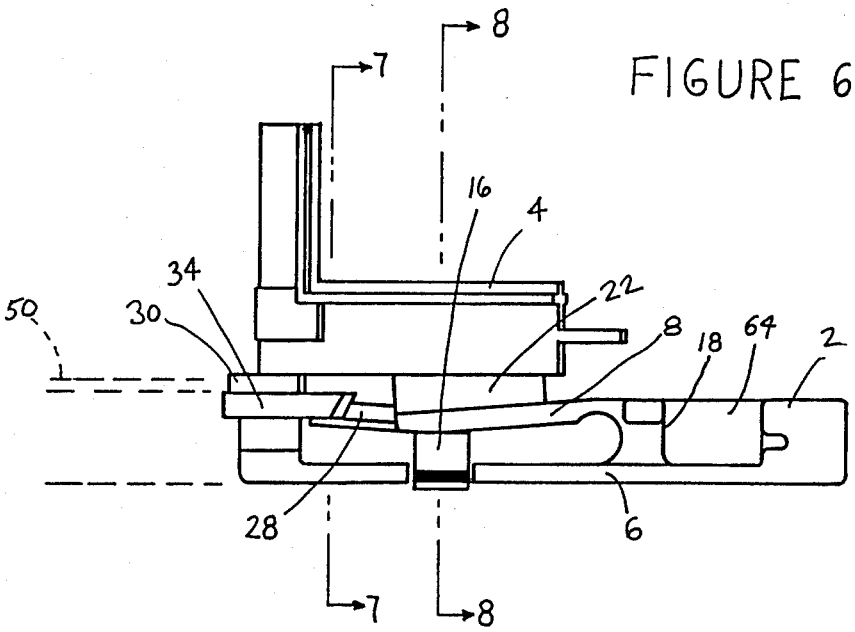
FIG. 6 is a side view of the shoe and part of the sash with the braking means in a partially engaged position.
Figure 7:
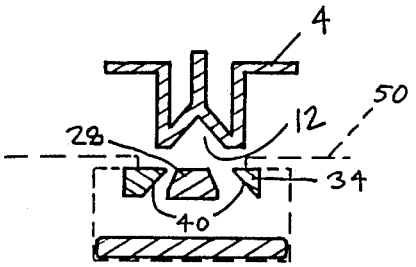
FIG. 7 is a sectional end view of the shoe along the lines 7—7 of FIG. 6.
Figure 8:
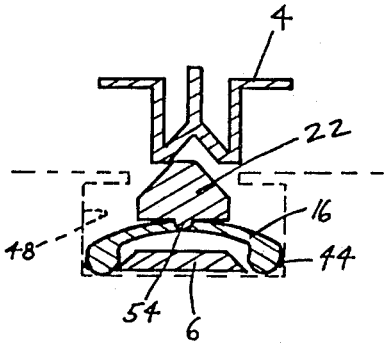
FIG. 8 is a sectional end view of the shoe along the lines 8—8 of FIG. 6.

In FIGS. 6, 7 and 8, the shoe is in a partially disengaged position and the ends 44 of the braking means 16 are exerting some pressure against the walls 48. The braking means 16 is in a locked position. The edges 40 of the flange 34 are still out of contact with the extension 28. The sash 4 is rotated slightly relative to the frame 50 and the shoe 2. The ridge 22 of the first engagement means 8 is partially disengaged from the indentation 12. In this position, the shoe 2 and sash 4 are prevented from sliding relative to the frame 50 under normal conditions. The braking force in this position is generally sufficient to support the weight of the sash and window. However, the shoe 2 and the sash 4 can be forced to move relative to the frame 50 by a sufficient external force.

Figure 9:
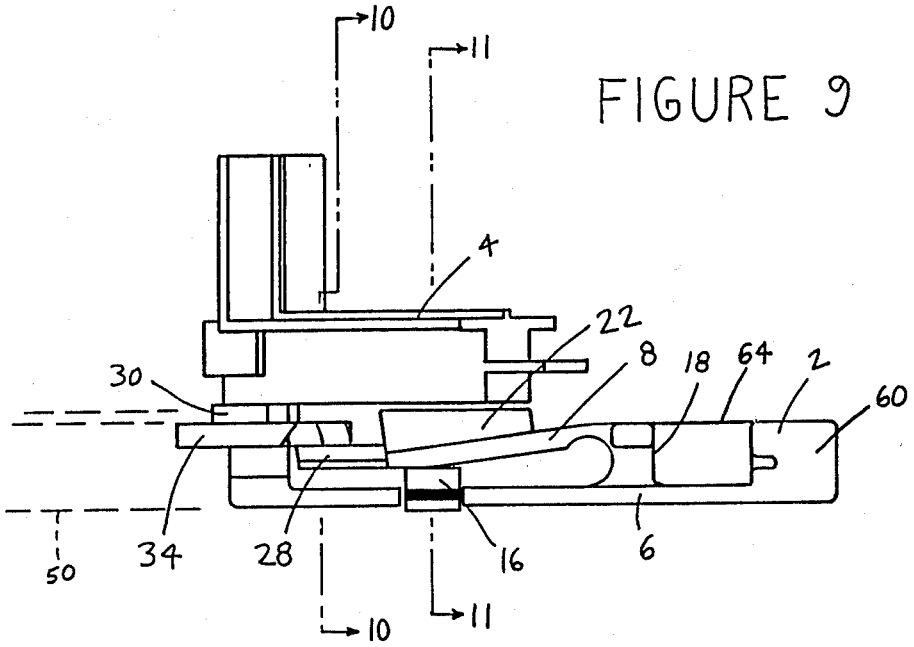
FIG. 9 is a side view of a shoe and part of a sash with the braking means in an engaged position.
Figure 10:
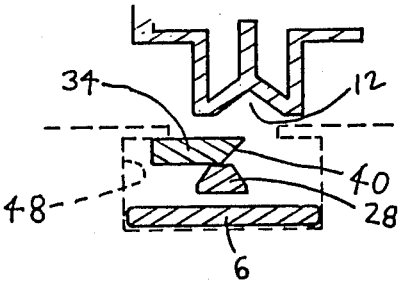
FIG. 10 is a sectional end view of the shoe and sash along lines 10—10 of FIG. 9.
Figure 11:
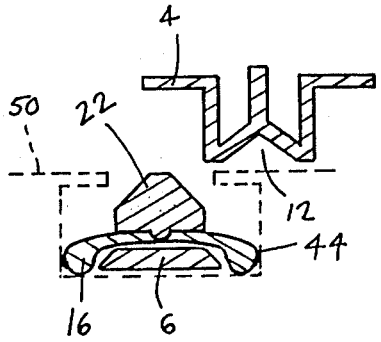
FIG. 11 is a sectional end view of the shoe and sash along the lines 11—11 of FIG. 9.

In the position shown in FIGS. 9 to 11 inclusive, the sash 4 is rotated further relative to the frame 50 and shoe 2 and the ridge 22 is completely disengaged from the indentation 12. In this position, one of the edges 40 of the flange 34 has overridden the extension 28 and the braking means 16 is forced fully downward so that the ends 44 exert maximum pressure against the walls 48 of the frame 50. Since the sash 4 has been rotated to a point that it is no longer in contact with the ridge 22,the projection 22 is held down solely by the flange 34, which maintains the braking means 16 in the locked position. The sash 4 does not completely clear the ridge 22 until it has been rotated by approximately 7° relative to the frame 50. The flange 34 begins to override the extension 28 when the sash has been rotated by approximately 7° relative to the frame 50 and the shoe 2. As the ridge 22 is extended closer to the second engagement means 10, the degree of rotation necessary for the sash 4 to clear the ridge 22 will increase. Also, as the width of the sash increases, the degree of rotation necessary for the sash 4 to clear the ridge 22 will increase. A sash of sufficient width will not clear the ridge 22 regardless of the degree of rotation.

In this position the sash 4 and shoe 2 are prevented from sliding relative to said frame 50 by the braking means 16. With extreme force exerted on the shoe 2, it can still be moved relative to the frame 50. However, the braking means 16 will easily support the weight of the sash and window.

In summary, when the shoe 2 is mounted between said sash 4 and said frame 50, and the engagement means 8, 10 on the shoe 2 are properly engaged with the corresponding engagement means 12, 14 on said sash 4, the sash 4 and shoe 2 are slidable relative to said frame 50. The first engagement means 8 and the third engagement means 12 are designed to disengage when said sash 4 is rotated relative to said frame 50. The braking means 16 is activated by said first engagement means 8 as soon as said first and third engagement means 8, 12 begin to disengage (see FIGS. 6 to 9 inclusive) to prevent said shoe and said sash from sliding relative to said frame. Additional pressure is exerted by said first engagement means 8 on said braking means 16 as said sash 4 is further rotated relative to said frame 50 until said first and third engagement means 8, 12 are completely disengaged from one another (see FIGS. 9 to 11). As soon as said first and third engagement means 8, 12 begin to disengage from one another, the first engagement means 8 forces said braking means 16 towards said base 6.

In the particular embodiment shown, the projection 8 on said shoe 2 begins to disengage from said indentation 12 on said sash 4 when the sash 4 is rotated relative to said frame 50 by an amount equal to or greater than approximately 3°. It will be readily apparent to those skilled in the art that the degree of rotation at which the braking means will begin to engage the walls of the frame can be varied by making changes in shape to either or both of the ridge 22 of the projection 8 and the indentation 12. It will be readily apparent to those skilled in the art that the size of the cutaway segment 38 or the shape and size of the flange 34 or extension 28 can be reduced or increased, thereby determining when the oblique surfaces 40 of the flange 34 will begin to override the extension 28 and assist in activating the braking means 16.

When the sash 4 is rotated back to the initial position relative to the frame 50 shown in FIGS. 3 to 5, the C-shaped portion 16 is flexible and resilient so that it will return automatically to its original position and said shoe 2 can then slide relative to said frame 50.

The indentation 12 of the third engagement means and the opening of the fourth engagement means 14 are preferably located in a corner key that is then mounted to form part of the sash 4. The corner key can be any suitable shape as long as it can be made part of the sash 4 and contains suitable third and fourth engagement means.

What I claim as my invention is:

1. A shoe for use with a sash of a closure, said sash having means thereon for engaging said shoe and being mounted in a frame, said shoe comprising a base with first and second engagement means located thereon, said sash having third and fourth engagement means located thereon, said third and fourth engagement means corresponding to said first and second engagement means respectively, said second and fourth engagement means together providing pivoting means so that said sash can be rotated relative to said frame about said second and fourth engagement means, said sash and said shoe being slidable relative to said frame when said sash is parallel to said frame and said shoe is mounted between said sash and said frame with said first engagement means properly engaged with said third engagement means and said second engagement means properly engaged with said fourth engagement means, said shoe thereby being engaged at two locations along the length of said sash, said first and third engagement means being designed to disengage when said sash is rotated to a non-parallel position relative to said frame, said base having braking means located thereon, said braking means being activated, by said first engagement means, as soon as said first and third engagement means begin to disengage to prevent said shoe and said sash from sliding relative to said frame.

2. A shoe as claimed in claim 1 wherein additional pressure is exerted by said first engagement means on said braking means as said sash is further rotated relative to said frame until said first and third engagement means are completely disengaged from one another.

3. A shoe as claimed in claim 2 wherein the first engagement means is pivotally mounted on said shoe relative to said base so that said braking means is located between part of said first engagement means and said base, said first engagement means forcing said braking means toward said base as soon as the first and third engagement means begin to disengage from one another.

4. A shoe as claimed in claim 3 wherein the first engagement means is a projection having a fixed end joined to said base and a free end capable of pivoting slightly about said fixed end, said projection having a ridge on an outer surface that is shaped to engage said third engagement means on said sash.

5. A shoe as claimed in claim 4 wherein the ridge of said projection has an inverted V-shaped cross-section over part of its length, said cross-section tapering gently to a flat surface, said third engagement means having an indentation with a shape that is a mirror image of the ridge of said projection so that said ridge will fit snugly within said third engagement means.

6. A shoe as claimed in claim 5 wherein the projection on said shoe begins to disengage from said indentation on said sash when the sash is rotated relative to said frame by an amount equal to or greater than approximately 3°.

7. A shoe as claimed in claim 6 wherein the second engagement means is a cylindrical post on said base mounted normal thereto, said fourth engagement means being an opening of similar size and shape to said post so that said post will fit snugly within said opening on said sash to allow said sash to pivot relative to said shoe and said frame.

8. A shoe as claimed in claim 6 wherein the projection has an extension located thereon so that a free end of said projection is immediately adjacent to said second and fourth engagement means, a sleeve being positioned between said second and fourth engagement means, said sleeve being shaped to interact with said extension so that when said sash is rotated relative to said frame by an amount equal to or greater than approximately 7°, part of said sleeve engages said extension, thereby forcing said projection against said braking means and assisting in activating said braking means.

9. A shoe as claimed in claim 8 wherein the second engagement means is a cylindrical post on said base mounted normal thereto and the sleeve is located between said post and said fourth engagement means, said sleeve having a hollow cylinder designed to snugly and rotatably fit over said post, said sleeve having a flange extending outwardly from an end adjacent to said base, said flange having a flat surface on a side opposite to said projection, a segment of said flange being removed on a side adjacent to said projection, said extension of said projection extending into said cut-away segment, said fourth engagement means on said sash having an opening that corresponds to an exterior shape of part of said sleeve including said flange, said exterior shape being non-circular so that they will rotate with said sash about said post and as said sash is rotated relative to said frame by an amount equal to or greater than approximately 7° in either direction, said flange engages said extension, thereby forcing said projection against said braking means.

10. A shoe as claimed in claim 9 wherein edges of the flange adjacent to the segment are shaped at an oblique angle to assist the sleeve in overriding the extension.

11. A shoe as claimed in claim 10 wherein edges of the extension are shaped at an oblique angle opposite to the oblique angle of the edges of the flange to assist the sleeve in overriding the extension, the sleeve fitting snugly within the opening of the sash so that the sleeve rotates as the sash rotates.

12. A shoe as claimed in claim 4 wherein the braking means is an elongated C-shaped portion with two ends extending adjacent to said base on either side of said base, with a centre of said C-shaped portion extending towards said projection, said braking means being flexible and resilient so that as the projection is forced against said C-shaped portion, it becomes flatter, thereby causing said ends to exert pressure against adjacent walls of said frame to prevent said shoe from sliding relative to said frame, said C-shaped portion returning to its original position after said projection is released, said shoe then being able to slide relative to said frame.

13. A shoe as claimed in claim 12 wherein the braking means is engaged with a lower surface of the projection at all times.

14. A shoe as claimed in claim 13 wherein the braking means has a suitable opening therein and a lower surface of the projection has a suitable bead thereon so that said bead will fit snugly within said opening.

15. A shoe as claimed in claim 14 wherein the ends of the C-shaped portion have a suitable surface to increase the friction between said ends and the walls of said frame.

16. A shoe as claimed in claim 15 wherein a rubbery material is affixed to ends of said braking means to increase friction between said ends and the walls of said frame.

17. A shoe as claimed in claim 16 wherein the shoe has three separate pieces, said pieces being the sleeve, the braking means and the remainder of said shoe, the remainder of said shoe including the base, the projection and the cylindrical post, the fixed end of said projection being integral with said base.

18. A shoe as claimed in claim 17 wherein there are means located on said shoe for anchoring and receiving one end of a spiral spring when said shoe is used with a double hung window.

19. A shoe as claimed in claim 2 wherein the closure is a window.

20. A shoe as claimed in any one of claims 5, 6 or 8 wherein the braking means is an elongated C-shaped portion with two ends extending adjacent to said base on either side of said base, with a centre of said C-shaped portion extending towards said projection, said braking means being flexible and resilient so that as the projection is forced against said C-shaped portion, it becomes flatter, thereby causing said ends to exert pressure against adjacent walls of said frame to prevent said shoe from sliding relative to said frame, said C-shaped portion returning to its original position after said projection is released, said shoe then being able to slide relative to said frame.

* * * * *